US010022641B1

(12) United States Patent
O'Rourke

(10) Patent No.: US 10,022,641 B1
(45) Date of Patent: Jul. 17, 2018

(54) THROUGH THE WATER PROJECTILE TOY

(71) Applicant: James P. O'Rourke, Brentwood, TN (US)

(72) Inventor: Thomas J. O'Rourke, Harlington, TX (US)

(73) Assignee: James P. O'Rourke, Brentwood, TN (US)

( * ) Notice: Subject to any disclaimer, the term of this patent is extended or adjusted under 35 U.S.C. 154(b) by 0 days.

(21) Appl. No.: 15/443,242

(22) Filed: Feb. 27, 2017

Related U.S. Application Data

(60) Provisional application No. 62/299,811, filed on Feb. 25, 2016.

(51) Int. Cl.

| | |
|---|---|
| ***A63H 23/12*** | (2006.01) |
| ***A63H 23/10*** | (2006.01) |
| ***F42B 6/02*** | (2006.01) |
| ***F41B 7/08*** | (2006.01) |
| ***A63H 23/14*** | (2006.01) |
| ***A63H 27/00*** | (2006.01) |

(52) U.S. Cl.
CPC ..... *A63H 23/10* (2013.01); *A63H 23/12* (2013.01); *A63H 23/14* (2013.01); *A63H 27/005* (2013.01); *F41B 7/08* (2013.01); *F42B 6/02* (2013.01)

(58) Field of Classification Search
CPC ..... A63B 43/00; A63H 27/005; A63H 27/14; A63H 23/10; F42B 6/02; F42B 6/04; F42B 6/08
See application file for complete search history.

(56) References Cited

U.S. PATENT DOCUMENTS

| | | | | |
|---|---|---|---|---|
| 5,514,023 | A | 5/1996 | Warner | |
| 5,807,198 | A * | 9/1998 | Grimm | A63B 43/002 473/613 |
| 7,052,357 | B2 * | 5/2006 | Silverglate | A63H 23/12 446/153 |
| 7,288,037 | B2 * | 10/2007 | Myers | A63B 43/06 473/570 |
| 8,348,789 | B1 * | 1/2013 | Walterscheid | F42B 6/003 473/578 |
| 8,689,773 | B2 * | 4/2014 | Walterscheid | F41B 5/0094 124/23.1 |
| 8,939,136 | B2 * | 1/2015 | Gaus | F41F 7/00 124/4 |
| 9,482,501 | B2 * | 11/2016 | Cummings | F42B 6/02 |
| 2014/0256479 | A1 * | 9/2014 | Bynum, Jr. | F42B 6/08 473/470 |

OTHER PUBLICATIONS

Delux Hawaiian Sling Shooter, available at http://www.diversdirect.com/scuba-diving/deluxe-hawaiian-sling-shooter?utm_source=google&utm_medium=cpc&utm_term=765&utm_campaign=cpc_shopping&gclid=CMTcvpvhsNICFQK4wAodk4QLHA (last accessed Feb. 27, 2017).

Hawaiian Sling, Traditional Shooter for diving, scuba, pole spear, available at https://www.amazon.com/Hawaiian-Sling-Traditional-Shooter-diving/dp/B00DD0GAH6 (last accessed Feb. 27, 2017).

* cited by examiner

*Primary Examiner* — John Ricci
(74) *Attorney, Agent, or Firm* — Shane V. Cortesi

(57) ABSTRACT

A projectile for launch in a body of water is described herein. The head of the projectile may be soft, the projectile may have a total specific gravity greater than about 0.95, the center of gravity may be located nearer the front end of the projectile as compared to the rear end and/or the length of the projectile relative to the maximum diameter may be (Continued)

greater than about 7:1. Methods of launching the same are also described herein.

19 Claims, 3 Drawing Sheets

THROUGH THE WATER PROJECTILE TOY

RELATED APPLICATIONS

This application claims priority under 35 USC 119 to U.S. Patent Application No. 62/299,811 filed Feb. 25, 2016, the contents of which are incorporated by reference herein in their entirety.

BACKGROUND

Technical Field

The present invention relates generally to projectiles and more specifically to through-the-water projectiles. More particularly, in various embodiments, the present invention relates to through-the-water projectiles used for sport and entertainment purposes. Even more specifically, this invention, in particular embodiments, pertains to through-the-water projectiles, which are non-lethal, yet perform with a sustained trajectory and are capable of accuracy for target shooting and other water activities.

BACKGROUND OF THE INVENTION

There are numerous water projectiles in the marketplace. Water projectile devices take many forms and may be used for lethal purposes, such as spear guns, or non-lethal purposes, such as a pool toy. They may have a non-descript, mostly functional aesthetic form, like a "Hawaiian sling", which is used for fishing, or they may be made to look like a submarine, torpedo, shark, fish or even a fictional character, in the case of some pool toys.

Lethal through-the-water projectiles are generally used for spearing fish and other marine animals for food and/or sport. Such through-the-water projectiles have long been used in hunting and there is a sense of accomplishment when an accurate shot is made. However one must be willing to kill and have a source of game, as well as surroundings that will not incur damage to make this a worthwhile activity. Moreover using them in the most common of swimming places, the backyard pool, should not be done for obvious reasons, including equipment damage and safety.

There is a desire the marketplace for through-the-water products that are accurately aim-able, can be launched at a target and sustain a predictable trajectory in a pool, without causing lethal or damaging consequences.

There are non-lethal underwater projectiles, but they are typically difficult to aim accurately and their accuracy toward a target at distance is less than adequate to replace the thrill of hunting devices such as a spear gun.

One such non-lethal through-the-water projectile device is Warner's Hand launchable hydrodynamic recreational device. See U.S. Pat. No. 5,514,023. However Warner's Hand launchable hydrodynamic recreational device calls for the approximate lengthwise center of the device to be its thickest part or largest diameter. As a result, associated weight is also concentrated near the lengthwise center. This causes the need for large stabilizing fins on Warner's device because the bulk of the weight is relatively close to said stabilizer fins in relation to its length. This increases the surface area which introduces more drag. Moreover, because there is roughly as much weight ahead of the lengthwise center, as there is aft of center, the device's trajectory is more easily sent off-course than is desirable. The device launches more like a glider than an aim-able device and takes its trajectory more from the last force applied to tip rather than the general direction and attitude of a long trailing shaft. This ease of being thrown off course makes hitting a target at distance a more challenging task than is typically entertaining. Even though Warner's device can be launched and sustain a trajectory in a general direction, the central location (fore to aft) of the center of gravity makes the device's trajectory more dependent on the vector of the force last applied to it than the orientation of the device when that force is exerted. The present invention describes a more forward concentration of mass and center of gravity, so the projectile's stabilizing fins may to have a smaller surface area because the moment arm is greater in relation projectiles length. This reduces drag and produces a more predictable trajectory. By this method, it is possible to have no stabilizers other than the shaft itself, if the moment arm is of sufficient length.

It is desirable to provide a non-lethal, through-the-water projectile that, permits a better potential for following a desired trajectory and is less vulnerable to slight force vector fluctuations that may occur during launch and that can be used in a swimming pool. This improved performance will make target and catch games underwater more enjoyable and less frustrating. Other needs and potential for benefit may be apparent to persons of skill in the art having studied this document.

BRIEF SUMMARY

It is an object of some embodiments of this invention to provide an accurate, non-lethal, sustained-trajectory, through-the-water projectile for target and other in-the-water activities as may be engaged in a swimming pool. In some embodiments, the advantages of the product are achieved by the design of said projectile, e.g., having a forward head with a resilient tip of sufficient surface area to disperse the projectiles inertia and minimize, if not eliminate the danger of damage to the equipment or surroundings and/or injury of another person within the launching or trajectory area, a center of gravity well forward of its lengthwise center, minimal surface area to reduce drag and tapering to a tail section of sufficient length to stabilize a trajectory in a direction opposite it's protrusion.

The length of the projectile, its total weight, the weight of its parts, the ratio of length to weight, the total specific gravity and specific gravity of certain parts of the projectile affects velocity, distance, accuracy and other factors in a number of ways.

The total specific gravity must be near or greater than one. This is so that floatation does not have too great an impact upon the projectiles trajectory.

However, in one embodiment, for example, a total specific gravity of slightly less than 1 may be desired. This would allow the projectile to travel in a sustained trajectory until the launching force is dissipated, at which time, the projectile floats to the top for retrieval. In this embodiment it may be desirable that the tail section's specific gravity be slightly more than one so that the projectile would float resilient side up and protruded tail down for safety reasons. This is true in most embodiments as well, because it is for the most part undesirable to have the thinner non-resilient tail section sticking up, whether that be on the surface, or the bottom, unless it sticking up serves some later to be determined purpose.

The shape of the projectiles head and especially the tip can vary depending on intended use. In all embodiments of the disclosed invention, it is desirable to: have at least about a 7:1 ratio of the projectile's length to its maximum diameter/width excluding stabilizers and thin protrusions such as wings, position the concentration of weight as far forward as possible and have the tip constructed of a resilient material with a durometer measuring less than 80 Shore A with sufficient surface area to disperse damage causing inertia. When considering a blunt tip wide enough to reduce the possibility of eye injury, a ratio of about 14:1 may be preferable. In addition, when considering an embodiment wherein the desired pattern of use may involve a person within the projectile's trajectory, a hardness of 40 to 60 Shore A may be preferable. Other considerations would be the ability for the projectile to slip through a liquid atmosphere at a speed commensurate with the desired pattern of use. In some embodiments it may desirable to create a projectile that will merely not damage the pool or itself. Other embodiments may require lower speeds if the pattern of use will be catch, pass, tag or something in between. A more blunt leading edge will disperse the projectiles inertial energy over a wider area as well as introduce a resistance to limit the velocity of the projectile and reduce the likelihood of damage or injury. Whereas a more sharply angled tip will reduce resistance and turbulence to allow speeds more similar to some lethal through-the-water projectiles without damage to itself or its environment.

In embodiments of the invention where maximum sustained trajectory and minimal damage is a priority over aesthetics, it is advisable to have the greatest diameter/width as close as possible to the leading edge of the tip and then reduce the diameter/width to a thin shaft making up the tail section within about the first 25% of the projectile's length. The longer the large diameter/width of the head is in relation to the thinner shaft, the more surface area there is to cause drag and the shorter the moment arm of the tail in relation to the center of gravity. This consideration must be balanced with the fact that the more perpendicular the angles of the taper are to the direction of the shaft, the more the water is redirected and therefore sustained trajectory can be lost in the turbulence. However, if the reduction of diameter/width is a curve to the shaft area, that is gradual and slightly accelerated, it can produce low pressure to capture a back draft of water current created by the displacement of water as the projectile moves through the water, recycling some of the launch energy for a greater sustained trajectory. The closer the sum total of the projectiles specific gravity is to the fluid atmosphere, the more impact this has on sustained low speed trajectory.

In a particular embodiment, the leading edge of the tip is a hemisphere to: dissipate force; and restrict velocity while displacing water smoothly so it may cause a back current where the water displaced returns to act upon the projectile, closing in on the projectile due to low pressures caused by the movement of a concentric accelerated curve as it passes through a liquid. In this embodiment, the curve forming the head from the leading edge to the shaft resembles an air foil so that lift will also work to sustain a desired trajectory. In other embodiments the lift may be more streamlined to sustain a greater velocity.

In some embodiments, such as those that may be produced as a pool toy rather than sporting goods equipment, aesthetics may be a priority over extraordinary performance. In these embodiments where aesthetic shape is chosen as a high priority, increasing the weight of the head can overcome the absence of the concepts disclosed in regard to the tapering of the head and by the introduction of stabilizers near the trailing end of the tail section. A predictable trajectory for a somewhat irregular shape can be also be improved by introducing geometry of the head or stabilizer (s) to cause the projectile to rotate around its longitudinal axis as it moves through the water.

In a preferred embodiment, the projectile is shaped for performance and may be launched by kinetic energy stored in an elastic band, spring or flexible substrate with a strong flexural strength and memory. In this embodiment it may not only be for the increase of surface of the tips impact area that said tip should be shaped somewhat blunt but also to limit velocity. The level of bluntness and the geometry of the tip can also govern the average sustained velocity. Shaped correctly with a radius greater than 1.25" or greater will limit possible eye injuries and choking hazards and if the aforementioned disclosure of an accelerating subtle curve to reduce to a minimal diameter/width and surface area is a used, a long, accurate sustained trajectory of moderate speed can be produced in the projectile.

In the aforementioned embodiment there must be an engagement point by which the kinetic energy is transferred to launch the projectile. Engagement points can be anywhere along the length of the projectile. However, since the length of the projectile and the user's arms deploying the projectile together may be a limitation considering the breadth of a user's reach. Therefore, the projectile should most efficiently be engaged in the rear, as an arrow is launched from a bow. And again like an arrow, the kinetic energy is gained within the length of the projectile as it is pulled back or cocked. In this embodiment, it may be of advantage to design the launcher to be wearable on the hand to allow said hand to be used in swimming.

In some embodiments, the projectile may be launched by hand. In these embodiments a preferred trajectory and speed may be established by a variety of methods. For example, one embodiment may move through the water more like a spear and another like a glider. This can be accomplished by implementing the concepts disclosed above.

In some embodiments, the present disclosure provides a through-the-water projectile comprising: an elongated smooth body having a total specific gravity greater than about 0.95 and a center of gravity, the elongated smooth body having a forward end, a rear end, a length extending from the forward end to the rear end and a maximum width perpendicular to the length, the elongated smooth body comprising: head forming the forward end of the elongated smooth body and comprising a resilient leading edge having a hardness of 80 shore A or less, the head comprising a head maximum width; and a rear section forming the rear end of the elongated body and rearwardly disposed relative to the head and comprising a shaft, the shaft comprising a shaft minimum width, the shaft minimum width less the head maximum width, wherein the center of gravity of the elongated smooth body is within about the forward 40% of the elongated smooth body length, and further wherein the ratio of the elongated smooth body length to the maximum width, excluding thin protrusions and stabilizers, is greater than 7:1.

Optionally, the shaft is integral with the head. Alternatively, the shaft is attached to the head. Optionally, the projectile further comprises at least one stabilizer, the at least one stabilizer attached or integral to the shaft and located within about the rear 20% of the elongated smooth body length. Optionally, the geometric shape of the elongated smooth body and/or stabilizers are configured to cause the elongated smooth body to spin/rotate around the length/longitudinal axis as it moves through water to aid the projectile to travel in a predictable trajectory. Optionally, the elongated body has a width/diameter of at least about 1 inch within about 1 inch from the leading edge and further wherein the leading edge is rounded or blunt. Optionally, the maximum width of the elongated smooth body is within about the forward 20% of the projectiles length and the head comprises a curve that defines the head's shape. Optionally, the curve defining the head is a concentric foil that tapers to the shaft similar to the curve of a cross section of the top side of an high lift airplane wing moving concentrically from the leading edge to the minimum diameter/width of the shaft to increase the effect of back drafting and aqua dynamic lift on the projectile's momentum. Optionally, the head and the shaft are generally cylindrical in shape, and further wherein the head maximum width is a diameter, the elongated smooth body width is a diameter, and the minimum shaft width is a diameter.

The projectile may be used in a method that includes for example the steps of providing the through-the-projectile and launching the through-the-water projectile in a body of water. Optionally, the projectile is launched by means of an elastomeric substrate or other kinetic launch mechanism. Optionally, the method further comprises using a hand wearable launcher to launch the through-the-water projectile. Optionally, the elongated smooth body rotates/spins around the length/longitudinal axis of the projectile as it moves through the body of water.

DETAILED DESCRIPTION

Figure 1:
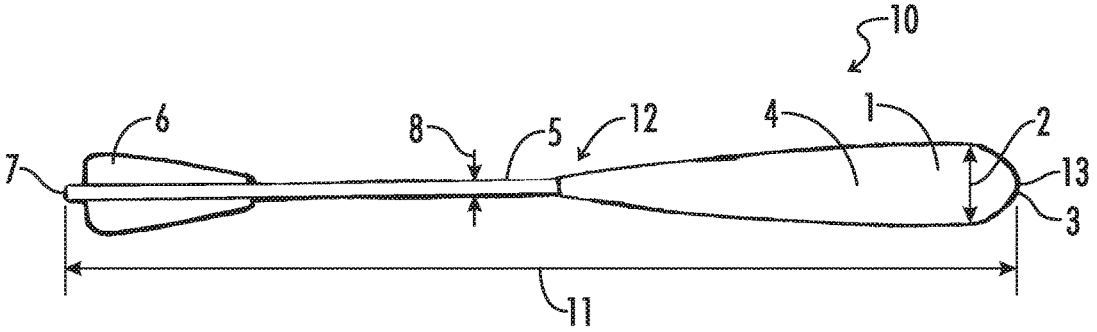
FIG. 1 illustrates a side elevation view of a projectile of one embodiment of the present invention.

FIG. 1 depicts an embodiment of the projectile, generally designated by the number 10, and shows the various parts and reference points of that particular embodiment. The projectile 10 may include a head portion 1, a maximum diameter/width 2, a leading edge or tip 3 of the projectile 10, a center of gravity 4, a shaft region 5 which is the smallest diameter/width 8 of the projectile 10 and stabilizer fins 6, which may or may not be necessary depending on the length to weight ratio and other factors.

For purposes of the present invention, the maximum diameter/width 2 and the minimum diameter/width 8 of the shaft 5 refer to the maximum diameter/width of the elongated body (more particularly head 1) and the minimum diameter/width of the shaft 5, as determined without taking into account any stabilizers 6 or thin protrusions, such as wings. In other words, the stabilizers 6 and thin protrusions (if present) are not taken into account when defining the maximum diameter/width 2 and the minimum diameter/width 5. In FIG. 1, it can also be seen that the shape of head 1 uses an accelerated foil shaped curve and not merely a consistent linear reduction of diameter/width as it tapers down from the maximum diameter/width 2 to the diameter/width 8 of the shaft 5. In other words, it is not a straight taper in this embodiment and the curve is similar to the curve of an airplane wing as it convexes along the axis of the shaft 5. The projectile 10 is in the form of an elongated smooth body 12 having a forward end 13 comprising the head 1 and a rear end 7 comprising the shaft 5. As shown in the illustrated embodiment, the center of gravity 4 is in the head portion 1. In particular embodiments, the center of gravity 4 is within the forward 40% of the projectile's length 11, meaning that if the elongated smooth body 12 has a length 11 of 10 inches for example, the center of gravity 4 is located no more than 4 inches from the tip/leading edge 3. In particular embodiments, the stabilizers 6 are within the rear 20% of the projectile's length 11, meaning that if the elongated smooth body 12 has a length 11 of 10 inches, for example, the stabilizers 6 are located within 2 inches of the rear end 7 of the elongated smooth body 12. In particular embodiments, the maximum diameter/width 2 is adjacent to the leading edge 3. For example, the maximum diameter/width 2 of the elongated smooth body is preferably within the forward 20% of the projectile's length 11, meaning that if the elongated smooth body 12 has a length of 18 inches for example, the maximum general diameter/width 2 is located no more than 3.6 inches from the tip/leading edge 3. The language "width/diameter" takes into account that the head 1 and the shaft 5 may be cylindrical in shape (i.e., have a diameter). Preferably, the head 1 and the shaft 5 are generally cylindrical in shape, it being understood that generally cylindrical includes tapered cylinders. Optionally, the head 1 has a width/diameter of 1 inch or more within the first 1 inch of the elongated body's length 11, as measured from the leading edge 3. This feature of creating a relatively wide head 1 adjacent to (i.e., at or near) the leading edge 3 is designed to prevent injury to user eyes.

Figure 2:
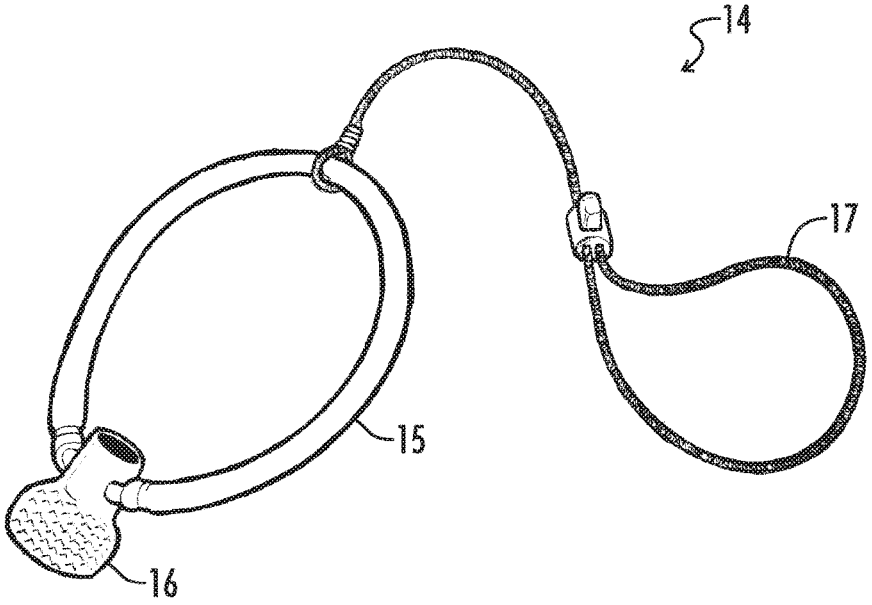
FIG. 2 illustrates a side perspective view of a projectile launcher of one embodiment of the present invention.

FIG. 2 shows depicts a simple launcher 14 that includes latex tubing or another elastomeric tube 15 to provide the elastic in which to store energy for release when launched, a molded engagement 16 for unidirectionally holding the projectile 10 from the rear end 7 and attached to the latex tubing 15 and a lanyard 17 to go around the wrist to free the hand for swimming or other activities without losing the launcher 14.

Figure 3:
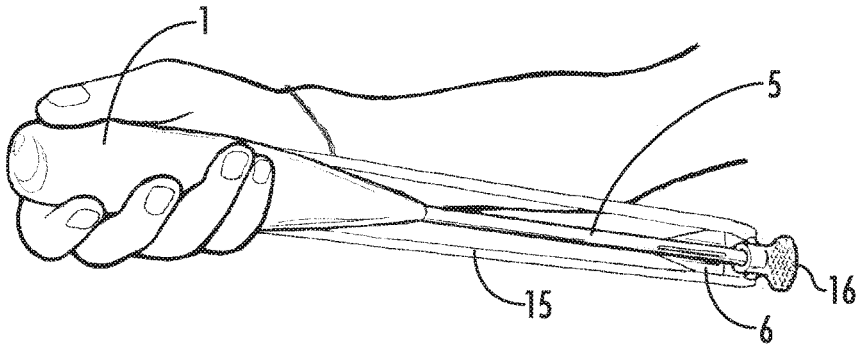
FIG. 3 illustrates a side perspective view of the projectile launcher of FIG. 2 being used to launch the projectile of FIG. 1.

FIG. 3 shows how the launcher 14 depicted in FIG. 2 may be used. The latex tube 15 goes around the fingers and back to the engagement. The projectile 10 may be pushed back from the head 1 or pulled from the rear end 7 to build kinetic energy. The head 1 may then simply be grasped to store that kinetic energy and aim the projectile 10. Releasing the head 1 causes the projectile 10 to launch in a predictable trajectory. The wrist is simply inserted into the loop of the lanyard 17.

Figure 4:
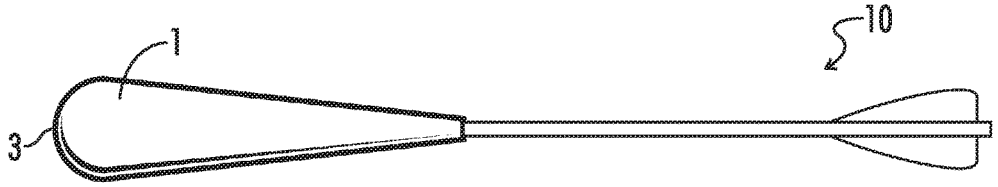
FIG. 4 illustrates a side elevation view of a projectile with a blunt tip of another embodiment of the present invention.

FIG. 4 depicts an embodiment of the projectile 10 that is velocity limiting. When launched at a force this projectile 10 will quickly slow to a speed that will be sustained by inertia and the back draft of water current created as the projectile 10 directs water around itself and as it slips through the liquid atmosphere. With a blunt tip 3, the water is directed to move more perpendicular to the elongated shape than horizontal. This perpendicular movement of water dissipates inertial force but becomes exponentially less of a factor as the projectile 10 slows. A more blunt tip 3 is desired when people may be present in the line of trajectory or when the projectile 10 is used for a catch or game of tag pattern of use.

Figure 5:
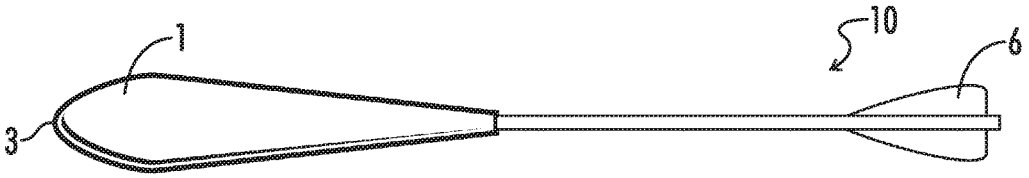
FIG. 5 illustrates a side elevation view of a projectile with a blunt tip of another embodiment of the present invention.

FIG. 5 also depicts an embodiment with a less blunt tip 3. This tip 3 also directs water away from the tip when moving through the water but because of the shape, the perpendicular displacement of water is not as great, and so, all other things being equal, the typical traveling speed of this projectile 10 is higher than that depicted in FIG. 4. A sharper, less blunt tip 3 is desirable when the only concern is the equipment such as the projectile 10 itself or the walls of a pool and the quick action of spearfishing is the goal. But some compromise is an option for older age groups or the wearing of adequate protection. A toy model may differ from a sporting goods model in this way.

Figure 6:
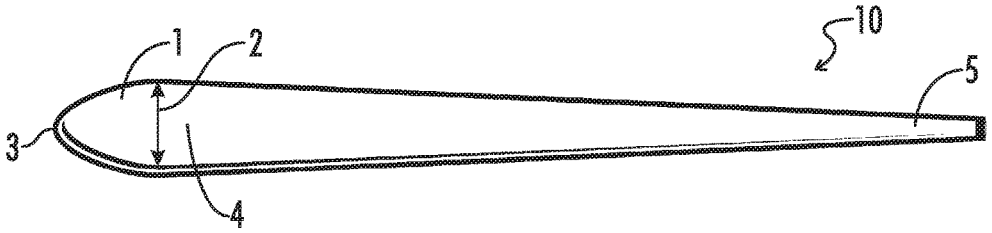
FIG. 6 illustrates a side elevation view of a projectile with a unitary design of another embodiment of the present invention.

FIG. 6 depicts an embodiment where the head 1 and the shaft 5 are a unitary design. This is perhaps the best choice for a hand launch because a more secure purchase for grip is provided, however a launcher 14 could be used. In this embodiment, more surface area is traded for more subtle transitions and therefore less turbulence. The shape is similar to the shape of an airplane wings curves moving concentric to the axis of its longitude throughout its length. The center of gravity 4 and maximum diameter/width 2 are still near the tip 3 and the shaft portion 5 still stabilizes the projectile's 10 trajectory through a liquid. Small stabilizers 6 can be used to great affect if added to the embodiment pictured.

Figure 7:
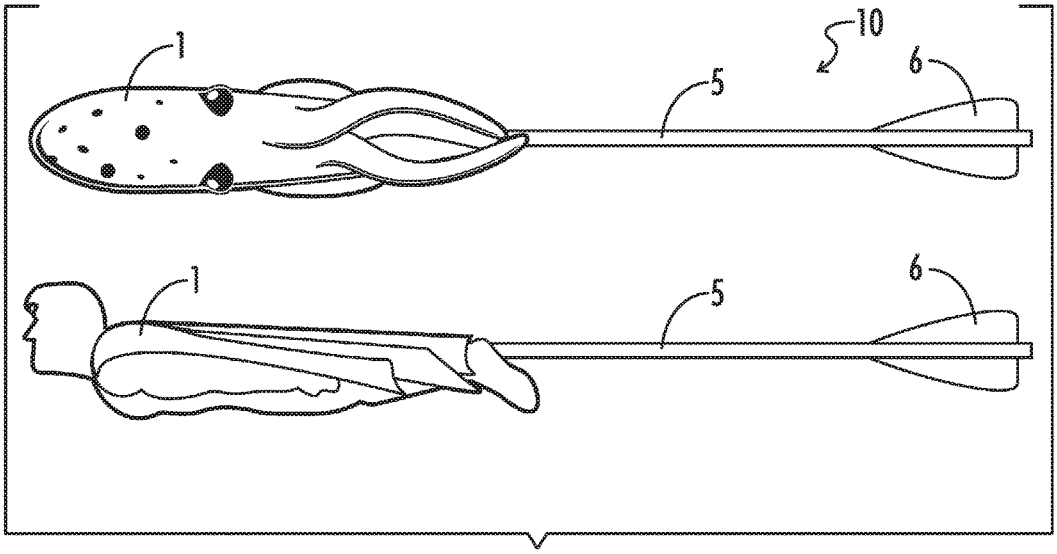
FIG. 7 illustrates a side elevation view of two projectiles of another embodiment of the present invention.

FIG. 7 depicts projectiles with character head 1 shapes. By symmetry and forward weighting the shape, said shape may be somewhat concentrically inconsistent. The more forward the weight and a greater ratio of weight forward along with a greater ratio of length to maximum diameter/width, the more an inconsistent shape may be overcome and provide the projectile 10 with a predictable trajectory. Designing the projectile 10 to spin as it travels can also help with some shapes where others may have a top, bottom, left and right in relation to the surface.

Figure 8:
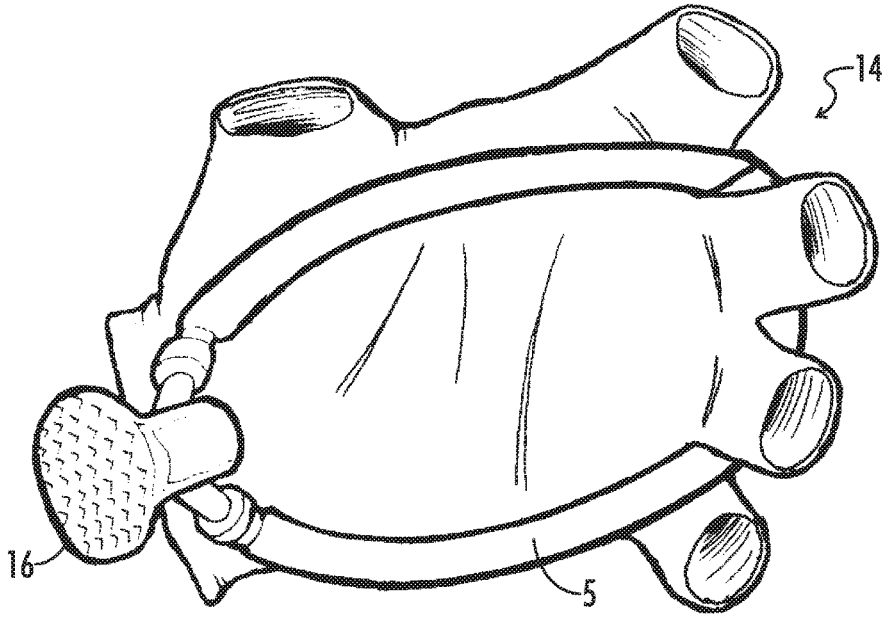
FIG. 8 illustrates a side perspective view of a projectile launcher and projectile of another embodiment of the present invention.

FIG. 8 depicts a launcher 14 with an elastomeric band 15 attached to the engagement 16 and a glove to free the users hand for swimming purposes.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A through-the-water projectile comprising an elongated smooth body comprising:

a) a forward end;

b) a rear end;

c) a length extending from the forward end to the rear end;

d) a maximum width perpendicular to the length;

e) a head forming the forward end of the elongated smooth body and comprising a resilient leading edge having a hardness of 80 shore A or less, the head comprising a head maximum width; and f) a rear section forming the rear end of the elongated body and rearwardly disposed relative to the head and comprising a shaft, the shaft comprising a shaft minimum width, the shaft minimum width less than the head maximum width, wherein the elongated smooth body has a total specific gravity greater than about 0.95 and a center of gravity, wherein the center of gravity of the elongated smooth body is within about the forward 40% of the elongated smooth body length, and further wherein the ratio of the elongated smooth body length to the maximum width, excluding thin protrusions and stabilizers, is greater than 7:1.

2. The through-the-water projectile of claim 1, wherein the shaft is integral with the head.

3. The through-the-water projectile of claim 1, wherein the shaft is attached to the head.

4. The through-the-water projectile of claim 1 further comprising at least one stabilizer, the at least one stabilizer attached or integral to the shaft and located within about the rear 20% of the elongated smooth body length.

5. The through-the-water projectile of claim 4, wherein the elongated smooth body comprises a longitudinal axis extending through a widthwise center of the elongated smooth body parallel to the elongated smooth body length, wherein the geometric shape of at least one of the elongated smooth body and the at least one stabilizer are configured to cause the elongated smooth body to spin around the smooth body longitudinal axis as the projectile moves through water to aid the projectile to travel in a predictable trajectory.

6. The through-the-water projectile of claim 1 wherein the elongated body has a width of at least about 1 inch within about 1 inch from the leading edge and further wherein the leading edge is rounded or blunt.

7. The through-the-water projectile of claim 1 wherein the maximum width of the elongated smooth body is within about the forward 20% of the projectile's length and the head comprises a curve that defines the head's shape.

8. The through-the-water projectile of claim 1 wherein the leading edge is generally hemispherical in shape, and further wherein the head gradually tapers rearwardly in width from the head maximum width to the shaft.

9. The through-the-water projectile of claim 1 wherein the leading edge is generally hemispherical in shape, wherein the head gradually tapers rearwardly in diameter from a maximum diameter to a minimum diameter that is substantially equal to the minimum width of the shaft and further wherein the shaft comprises a plurality of fins radiating from the shaft.

10. A method of using the through-the-water projectile of claim 1, comprising the steps of a) providing the through-the-water-projectile of claim 1 and b) launching the through-the-water projectile in a body of water.

11. The method of claim 10 wherein step b) comprises using a launcher comprising an elastic band to launch the through-the-water projectile in the water.

12. The method of claim 11 wherein the launcher is a hand wearable launcher.

13. The method of claim 10, wherein the elongated smooth body comprises a longitudinal axis extending through a widthwise center of the elongated smooth body parallel to the elongated smooth body length, and further wherein the elongated smooth body spins around the elongated smooth body longitudinal axis as the projectile moves through the body of water.

14. The method of claim 10 wherein step b) comprises i) engaging the rear end of the elongated smooth body with a launcher with an elastic band having stored kinetic energy and ii) using the stored kinetic energy from the launcher to launch the elongated smooth body through the water in a sustained trajectory.

15. The method of claim 14, wherein the elongated smooth body comprises a longitudinal axis extending through a widthwise center of the elongated smooth body parallel to the elongated smooth body length, wherein the elongated smooth body spins around the elongated smooth body longitudinal axis as the projectile moves through the body of water.

16. The method of claim 14 wherein the method comprises grasping the projectile by the head while launching the projectile.

17. The method of claim 10 wherein the leading edge is generally hemispherical in shape, wherein the head gradually tapers rearwardly in width from the head maximum width to the shaft.

18. The method of claim 10 wherein the leading edge is generally hemispherical in shape, wherein the head gradually tapers rearwardly in diameter from a maximum diameter to a minimum diameter that is substantially equal to the minimum width of the shaft and further wherein the shaft comprises a plurality of fins radiating from the shaft.

19. The method of claim 10 wherein the resilient leading edge has a hardness of between 40 to 60 shore A.

* * * * *